US011128059B2

(12) United States Patent
Rogers

(10) Patent No.: US 11,128,059 B2
(45) Date of Patent: Sep. 21, 2021

(54) ANTENNA ASSEMBLY HAVING ONE OR MORE CAVITIES

(71) Applicant: THE BOEING COMPANY, Chicago, IL (US)

(72) Inventor: John E. Rogers, Huntsville, AL (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 16/443,256

(22) Filed: Jun. 17, 2019

(65) Prior Publication Data

US 2020/0395672 A1 Dec. 17, 2020

(51) Int. Cl.

| | |
|---|---|
| ***H01Q 21/06*** | (2006.01) |
| ***H01Q 1/42*** | (2006.01) |
| ***H01Q 21/00*** | (2006.01) |
| ***H01Q 9/04*** | (2006.01) |
| ***H01Q 1/28*** | (2006.01) |

(52) U.S. Cl.

CPC ..... *H01Q 21/065* (2013.01); *H01Q 1/28* (2013.01); *H01Q 1/42* (2013.01); *H01Q 9/0428* (2013.01); *H01Q 9/0457* (2013.01); *H01Q 21/0075* (2013.01); *H01Q 1/286* (2013.01)

(58) Field of Classification Search

CPC ..... H01Q 1/28; H01Q 1/42; H01Q 9/0428; H01Q 21/065; H01Q 21/0075; H01Q 1/286; H01Q 9/0407; H01Q 9/045; H01Q 9/0457; H01Q 9/0464; H01Q 21/0081

See application file for complete search history.

(56) References Cited

U.S. PATENT DOCUMENTS

| | | | | |
|---|---|---|---|---|
| 6,140,968 | A * | 10/2000 | Kawahata | H01Q 1/243 343/700 MS |
| 7,889,150 | B2 * | 2/2011 | Gottwald | H01Q 1/3233 343/878 |
| 9,772,422 | B2 | 9/2017 | Hull | |
| 2005/0200531 | A1 * | 9/2005 | Huang | H01Q 21/0006 343/700 MS |
| 2016/0351996 | A1 * | 12/2016 | Ou | H01Q 21/065 |
| 2020/0106192 | A1 * | 4/2020 | Avser | H01Q 9/0414 |

OTHER PUBLICATIONS

Fonseca, M. A., et al., "Flexible wireless passive pressure sensors for biomedical applications," Hilton Head 2006, Jun. 2006.

Abad, E., et al., "Flexible tag microlab development: gas sensors integration in RFID flexible tags for food logistics," Sensors and Actuators B, Jul. 2007.

(Continued)

*Primary Examiner* — Robert Karacsony

(74) *Attorney, Agent, or Firm* — The Small Patent Law Group LLC; Joseph M. Butscher

(57) ABSTRACT

An antenna assembly and method of forming the same includes a dielectric support base including an antenna element layer having one or more antenna elements, and a cavity layer coupled to the dielectric support base. The cavity layer includes a main body having one or more cavities. The one or more antenna elements are disposed within the one or more cavities.

18 Claims, 3 Drawing Sheets

(56) References Cited

OTHER PUBLICATIONS

Rida, A., et al., "Conductive inkjet-printed antennas on flexible low-cost paper-based substrates for RFID and WSN applications," IEEE Antennas and Propagation Magazine, Jun. 2009.
Schwerdt, H. N., et al., "A fully passive wireless microsystem for recording of neuropotentials using RF backscattering methods," Journal of Microelectromechanical Systems, Aug. 2011.
Rose, D. P., et al., "Adhesive RFID sensor patch for monitoring of sweat electrolytes," IEEE Transactions on Biomedical Engineering, Jun. 2015.
Bito, J., et al., "Ambient RF energy harvesting from a two-way talk radio for flexible wearable wireless sensor devices utilizing inkjet printing technologies," IEEE Transactions on Microwave Theory and Techniques, Dec. 2015.
Escobedo, P., et al., "Flexible passive near field communication tag for multigas sensing," Analytical Chemistry, Dec. 2016.
Xu, G., et al., "Passive and wireless near field communication tag sensors for biochemical sensing with smartphone," Sensors and Actuators B, Feb. 2017.
Pozar, D.M., "Microstrip antenna aperture-coupled to a microstrip line," Electronics Letters, Jan. 1985.
Pozar, D.M., Kaufman, B., "Increasing the bandwidth of a microstrip antenna by proximity coupling," Electronics Letters, Apr. 1987.
Hallil, H., et al., "Feasibility of wireless gas detection with an FMCW RADAR interrogation of passive RF gas sensor," IEEE Sensors, Nov. 2010.
Iwasaki, H., "A circularly polarized small-size microstrip antenna with a cross slot," IEEE Transactions on Antennas and Propagation, Oct. 1996.
Papapolymerou, I., et al., "Micromachined patch antennas," IEEE Transactions on Antennas and Propagation, Feb. 1998.
Gauthier, G.P., et al., "A 94 GHz aperture-coupled micromachined microstrip antenna," IEEE Transactions on Antennas and Propagation, Dec. 1999.
Cook, B.S., et al., "Multilayer inkjet printing of millimeter-wave proximity-fed patch arrays on flexible substrates," IEEE Antennas and Wireless Propagation Letters, Oct. 2013.
Sorkherizi, M.S., et al., "Planar high-efficiency antenna array using new printed ridge gap waveguide technology," IEEE Transactions on Antennas and Propagation, Jul. 2017.
Yi, X., et al., "Passive wireless smart-skin sensor using RFID-based folded patch antennas," International Journal of Smart and Nano Materials, Mar. 2011.
Zhang, N., et al., "Temperature sensor based on 4H-silicon carbide on diode operational from 20C to 600C," Applied Physics Letters, Feb. 2014.
Rogers, J.E., et al., "A passive wireless microelectromechanical pressure sensor for harsh environments," Journal of Microelectromechanical Systems, Feb. 2018.

* cited by examiner

ANTENNA ASSEMBLY HAVING ONE OR MORE CAVITIES

FIELD OF EMBODIMENTS OF THE DISCLOSURE

Embodiments of the present disclosure generally relate to antenna assemblies, and more particularly, to antenna assemblies having one or more cavities.

BACKGROUND OF THE DISCLOSURE

An antenna typically includes an array of conductors electrically connected to a receiver or a transmitter. The transmitter provides an electric current to terminals of the antenna, which, in response, radiates electromagnetic waves. Alternatively, as radio waves are received by the antenna, an electrical current is generated at the terminals, which, in turn is applied to the receiver. Various types of known antennas are configured to transmit and receive radio waves with a reciprocal behavior.

In some aerospace applications, there is a need for antennas that are capable of being positioned on conformal or non-planar surfaces, such as wings and fuselages of aircraft. Small aircraft, such as unmanned aerial vehicles (UAVs) or drones, in particular, have surfaces with low radii of curvature. Such aircraft typically need light weight antennas with low aerodynamic drag and low visibility. Further, various surfaces of aircraft may be formed from conductive or carbon fiber materials, which are known to change the electrical behavior of antennas, such as monopole and dipole antennas and derivatives (for example, whip, blade, Yagi, and other such antennas).

Microstrip antennas such as patch antennas are used in various applications. However, known planar microstrip antennas typically exhibit limited gain and bandwidth due to their small size and low profile.

SUMMARY OF THE DISCLOSURE

A need exists for a compact and efficient antenna assembly. Further, a need exists for an antenna assembly that provides improved gain and bandwidth.

With those needs in mind, certain embodiments of the present disclosure provide an antenna assembly that includes a dielectric support base including an antenna element layer having one or more antenna elements, and a cavity layer coupled to the dielectric support base. The cavity layer includes a main body having one or more cavities. The one or more antenna elements are disposed within the one or more cavities. In at least one embodiment, the one or more antenna elements include at least two antenna elements.

In at least one embodiment, the dielectric support base includes a dielectric layer. The one or more antenna elements are disposed on the dielectric layer.

As an example, the one or more antenna elements include a main body having a slot.

In at least one embodiment, the dielectric support base further includes a microstrip feed network coupled to the one or more antenna elements. In at least one embodiment, the microstrip feed network is underneath the one or more antenna elements.

In at least one embodiment, the dielectric support base further includes a feed network layer having a microstrip feed network that couples to the one or more antenna elements. The feed network layer is coupled to the antenna element layer. The dielectric support base may also include a spacing layer between the antenna element layer and the feed network layer.

In at least one embodiment, a backside ground plane is coupled to the dielectric support base. For example, the backside ground plane may couple to a dielectric layer of the dielectric support base.

In at least one embodiment, a dielectric cover is secured over the cavity layer. For example, the one or more antenna elements are enclosed within the one or more cavities between an upper surface of a dielectric layer of the dielectric support base, interior surfaces of the main body of the cavity layer, and a lower surface of the dielectric cover.

Certain embodiments of the present disclosure provide a method of forming an antenna assembly. The method includes providing a dielectric support base, wherein said providing the dielectric support base includes forming an antenna element layer having one or more antenna elements, and wherein said forming the antenna element layer includes disposing the one or more antenna element elements on a first dielectric layer; forming one or more cavities through a main body to form a cavity layer including a main body having one or more cavities; and coupling the cavity layer to the dielectric support base, wherein said coupling includes disposing the one or more antenna elements within the one or more cavities.

Certain embodiments of the present disclosure provide an antenna assembly that includes a dielectric support base including an antenna element layer having antenna elements. The antenna elements are disposed on a first dielectric layer. The dielectric support base also includes a feed network layer having a microstrip feed network that couples to the antenna elements. The feed network layer is coupled to the antenna element layer. The dielectric support base also includes a spacing layer between the antenna element layer and the feed network layer. A backside ground plane is coupled to the dielectric support base. The backside ground plane couples to a second dielectric layer of the dielectric support base. A cavity layer is coupled to the dielectric support base. The cavity layer includes a main body having cavities. The antenna elements are disposed within the cavities. A dielectric cover is secured over the cavity layer. The antenna elements are enclosed within the cavities between an upper surface of the first dielectric layer, interior surfaces of the main body of the cavity layer, and a lower surface of the dielectric cover.

DETAILED DESCRIPTION OF THE DISCLOSURE

The foregoing summary, as well as the following detailed description of certain embodiments, will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Certain embodiments of the present disclosure provide an antenna assembly including a dielectric support base, which may be formed of a composite material. The dielectric support base has an antenna element layer having one or more antenna elements, and a cavity layer including a main body having one or more cavities. The antenna elements are disposed within the cavities.

In at least one embodiment, the antenna assembly has a low cross-polarization and includes one or more proximity-coupled antenna elements on a surface of a radio frequency (RF) board. An embedded microstrip feed network within the RF board may be proximity-coupled to the antenna elements. A ground plane on the backside of the RF board provides efficient signal propagation along the microstrip feed network. A cavity layer including one or more cavities is coupled to (for example, attached) to the RF board. The antenna element(s) are disposed within the one or more cavities. A dielectric cover is disposed over the cavity layer.

Figure 1:
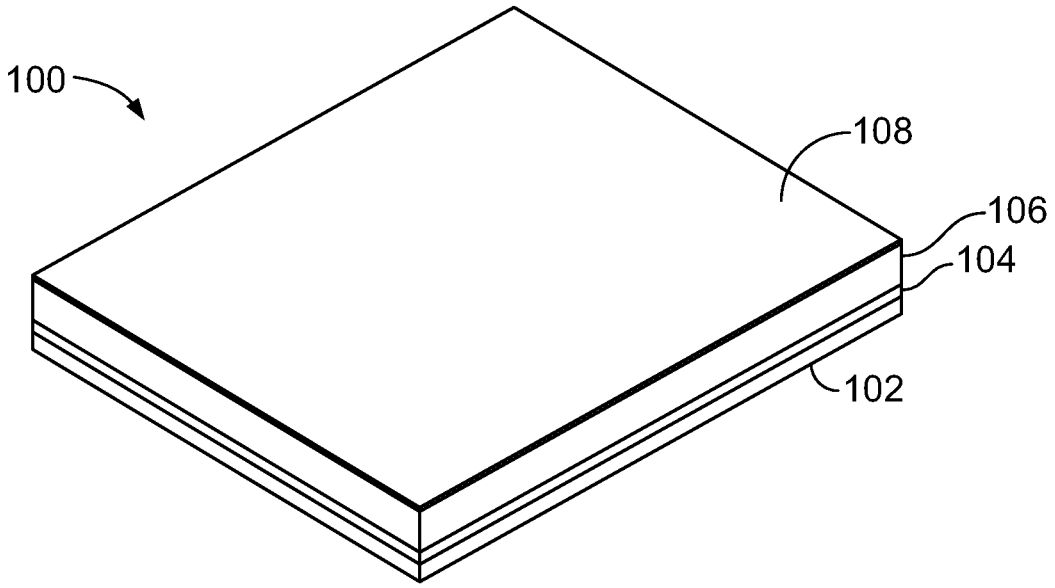
FIG. 1 illustrates a perspective top view of an antenna assembly, according to an embodiment of the present disclosure.

The antenna assemblies described herein efficiently propagate signals, resist electrical interference in relation to surfaces on which the antenna assemblies are mounted or otherwise secured, and increase gain and bandwidth for a compact assembly. The antenna assembly may be manufactured using a combination of subtractive (for example, laser etching, milling, wet etching, and the like) and additive (for example, printing, film deposition, and the like) processes FIG. 1 illustrates a perspective top view of an antenna assembly 100, according to an embodiment of the present disclosure. The antenna assembly 100 includes a ground plane, such as a backside ground plane 102. A dielectric support base 104 (such as may be formed from one or more composite materials) is disposed over the backside ground plane 102. The backside ground plane 102 is disposed on the backside of the dielectric support base 104. A cavity layer 106 is disposed over the dielectric support base 104, such that the dielectric support base 104 is sandwiched between the backside ground plane 102 and the cavity layer 106. A dielectric cover 108 is disposed over the cavity layer 106, such that the cavity layer 106 is sandwiched between the dielectric support base 104 and the dielectric cover 108.

Figure 2:
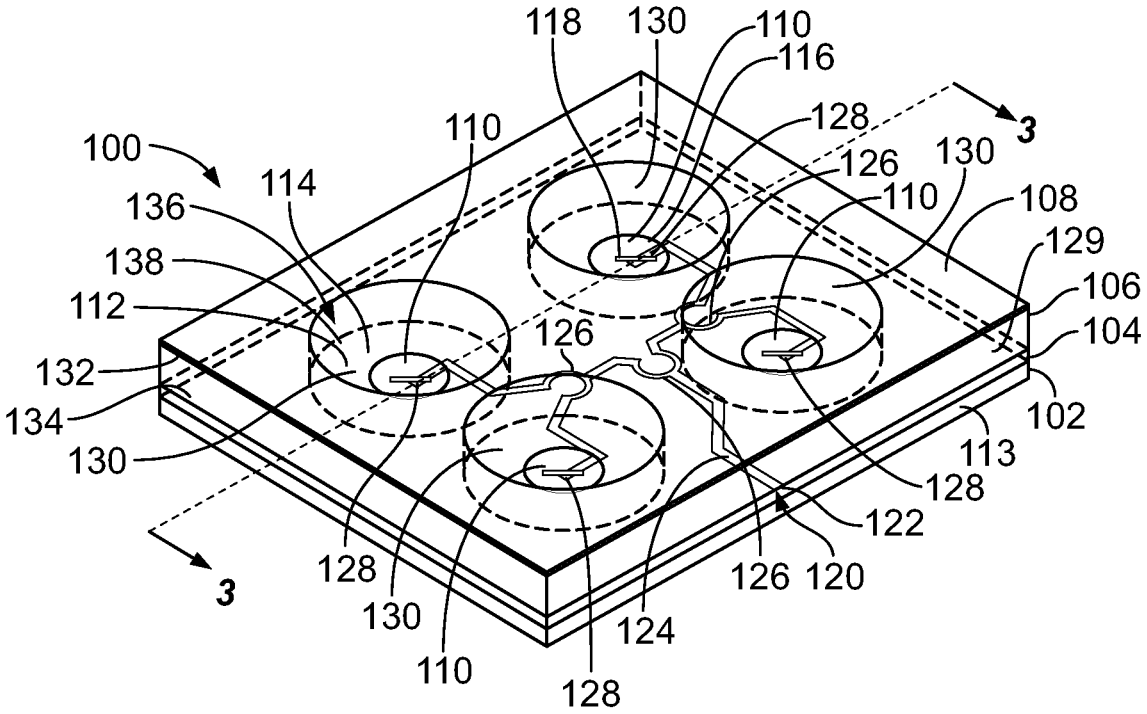
FIG. 2 illustrates a perspective top transparent view of the antenna assembly.

FIG. 2 illustrates a perspective top transparent view of the antenna assembly 100. Portions of the antenna assembly 100 are transparent in order to show the components within the dielectric support base 104 and the cavity layer 106.

The dielectric support base 104 includes one or more antenna elements 110 disposed on a first or upper surface 112 of a dielectric layer 114. The upper surface 112 provides the first or upper surface 112 of the dielectric support base 104. The upper surface 112 is opposite from a second or lower surface 113 of the dielectric support base 104. As shown, the antenna assembly 100 may include four antenna elements 110. Optionally, the dielectric support base 104 may include more than four antenna elements 110, such as eight or sixteen antenna elements 110, or less than four antenna elements 110, such as one or two antenna elements 110.

In at least one embodiment, each antenna element 110 includes a disk-shaped main body 116 having a slot 118 formed therethrough. Accordingly, the antenna elements 110 are circular, slotted antenna elements. The slot 118 of each antenna element 110 increases bandwidth and promotes circular polarization. That is, the slot 118 forces current to rotate around the antenna element 110. Alternatively, the antenna elements 110 may be sized and shaped differently than shown. For example, the antenna elements 110 may have a rectangular axial cross section. In at least one other embodiment, at least one of the antenna elements 110 may not include a slot 118.

The antenna assembly 100 also includes a microstrip feed network 120. In at least one embodiment, the microstrip feed network 120 (formed of a conductive material) is positioned underneath the antenna elements 110. For example, the microstrip feed network 120 may be embedded within the dielectric layer 114, as opposed to being disposed on the upper surface 112. As another example, the microstrip feed network 120 may be positioned on, or embedded within, an additional dielectric layer that is underneath the dielectric layer 114. Alternatively, the microstrip feed network 120 may be disposed on the upper surface 112 of the dielectric layer 114. The microstrip feed network 120 includes an input 122 that couples to a conduit 124 that connects to one or more power dividers 126, which, in turn, connect to antenna terminals 128 that couple to the antenna elements 110.

The cavity layer 106 includes a main body 129 having cavities 130 formed therethrough. The main body 129 may be formed of a conductive material with the cavities 130 formed (such as milled) through the main body 129. Each cavity 130 extends between and through a first or upper surface 132 and a second or lower surface 134 of the cavity layer 106. The cavities 130 are voids or spaces that extend through the cavity layer 106. Each antenna element 110 is disposed on the upper surface 112 of the dielectric layer 114 and extends into a respective cavity 130. For example, each of the four antenna elements 110 shown in FIG. 2 extends into a respective one of the four cavities 130. The cavities 130 are closed at a first (or upper) end 136 by the dielectric cover 108, and closed at a second (or lower) end 138 by the upper surface 112.

The cavities 130 in FIG. 2 are shown as cylindrically shaped cavities 130. Alternatively, the cavities 130 may be sized and shaped differently than shown. For example, the cavities 130 may have a rectangular prism shape.

In operation, a time-varying power signal is applied to the antenna assembly 100 via the input 122. The time-varying power signal is distributed to the antenna elements 110 via the microstrip feed network 120.

In at least one embodiment, the antenna assembly 100 is configured to operate at or near 10 GHz. In at least one exemplary embodiment, it has been found that the antenna assembly 100 provides antenna gain of approximately 10.7 dBi with a 2:1 axial ratio beamwidth of 52 degrees. It has been found that such increased performance is due, at least in part, to the cavities 130. By way of comparison, a similar antenna assembly without the cavities exhibits a gain of 10.9 dBi with no 2:1 axial ratio beamwidth. Moreover, the 2:1 voltage standing wave ratio (VSWR) bandwidth of the antenna assembly 100 is approximately 1000 MHz, compared to approximately 750 MHz for an antenna assembly without cavities. As such, it has been found that the antenna assembly 100 having the cavities 130 exhibits improved gain bandwidth performance and circular polarization over an antenna assembly without the cavities.

Figure 3:
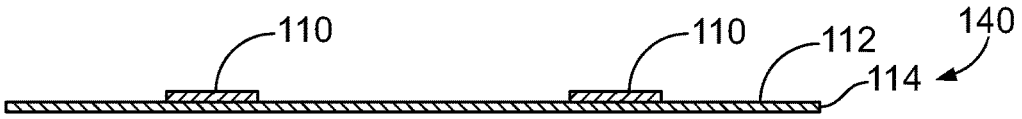
FIG. 3 illustrates a cross-sectional view of an antenna element layer including antenna elements on a dielectric layer of a dielectric support base through line 3-3 of FIG. 2.

FIG. 3 illustrates a cross-sectional view of an antenna element layer 140 having the antenna elements 110 on the dielectric layer 114 (or first dielectric layer) of the dielectric support base 104 (shown in FIGS. 1 and 2) through line 3-3 of FIG. 2, according to an embodiment of the present disclosure. The dielectric layer 114 supporting the antenna elements 110 provides the antenna element layer 140 of the dielectric support base 104. As noted, in at least one embodiment, the dielectric support base 104 is formed from a plurality of dielectric layers, including the dielectric layer 114. The dielectric layer 114 is formed of a dielectric material with a low loss tangent. The dielectric layer 114 may be formed through subtractive processes, such as laser etching, milling, wet etching, or the like. The antenna elements 110 may be disposed on the upper surface 112 of the dielectric layer 114. Alternatively, the antenna elements 110 may be additively printed or deposited on the upper surface 112.

Figure 4:
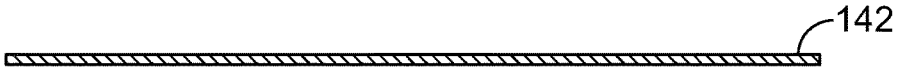
FIG. 4 illustrates a cross-sectional view of a spacing layer of the dielectric support base through line 3-3 of FIG. 2.

FIG. 4 illustrates a cross-sectional view of a spacing layer 142 of a dielectric support base 104 (shown in FIGS. 1 and 2) through line 3-3 of FIG. 2, according to an embodiment of the present disclosure. The spacing layer 142 may be a second dielectric layer that forms part of the dielectric support base 104. The spacing layer 142 is formed of a dielectric material with a low loss tangent. The spacing layer 142 may be formed through subtractive processes, such as laser etching, milling, wet etching, or the like. The spacing layer 142 is configured to space the antenna element layer 140 from a feed network layer. Optionally, the antenna assembly 100 may not include the spacing layer 142.

Figure 5:
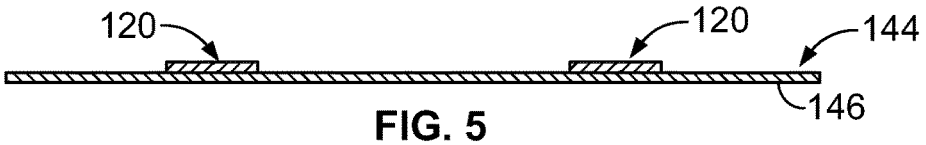
FIG. 5 illustrates a cross-sectional view of a feed network layer of the dielectric support base through line 3-3 of FIG. 2.

FIG. 5 illustrates a cross-sectional view of a feed network layer 144 of a dielectric support base 104 (shown in FIGS. 1 and 2) through line 3-3 of FIG. 2, according to an embodiment of the present disclosure. The feed network layer 144 includes a dielectric layer 146 (or third dielectric layer) onto which the microstrip feed network 120 is disposed. The dielectric layer 146 is formed of a dielectric material with a low loss tangent. The dielectric layer 146 may be formed through subtractive processes, such as laser etching, milling, wet etching, or the like. Alternatively, the microstrip feed network 120 may be additively printed or deposited on the dielectric layer 146.

Figure 6:
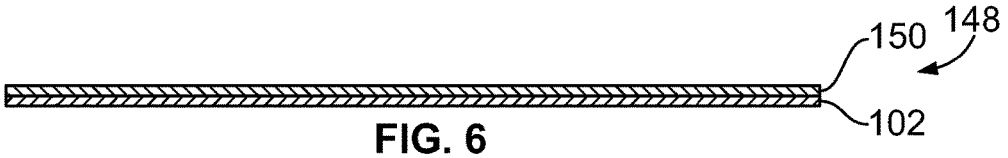
FIG. 6 illustrates a cross-sectional view of a ground layer through line 3-3 of FIG. 2.

FIG. 6 illustrates a cross-sectional view of a ground layer 148 through line 3-3 of FIG. 2, according to an embodiment of the present disclosure. The ground layer 148 includes a dielectric layer 150 (or fourth dielectric layer) disposed over the backside ground plane 102. The dielectric layer 150 may be the fourth dielectric layer of the dielectric support base 104 (shown in FIGS. 1 and 2). The dielectric layer 150 is formed of a dielectric material with a low loss tangent. The dielectric layer 150 may be formed through subtractive processes, such as laser etching, milling, wet etching, or the like. Alternatively, the dielectric layer 150 may be deposited onto the backside ground plane 102, or vice versa, such as through printing or film deposition.

Figure 7:
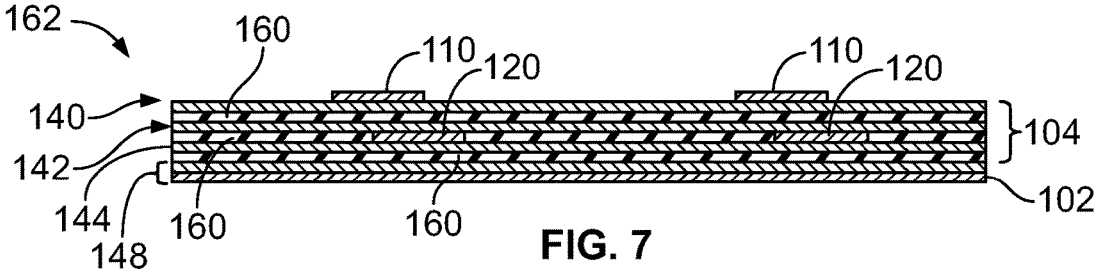
FIG. 7 illustrates a cross-sectional view of the dielectric support base coupled to the backside ground plane through line 3-3 of FIG. 2.

FIG. 7 illustrates a cross-sectional view of the dielectric support base 104 coupled to the backside ground plane 102 through line 3-3 of FIG. 2. The antenna element layer 140 is stacked over the spacing layer 142, which is stacked over the feed network layer 144, which is stacked over the ground layer 148. The antenna element layer 140, the spacing layer 142, the feed network layer 144, and the ground layer 148 are then bonded together (such as via lamination with adhesive films), so that adhesive laminate 160 fills spaces therebetween, and secures the antenna element layer 140, the spacing layer, the feed network layer 144, and the ground layer 148 together to form an antenna sub-assembly 162.

Figure 8:
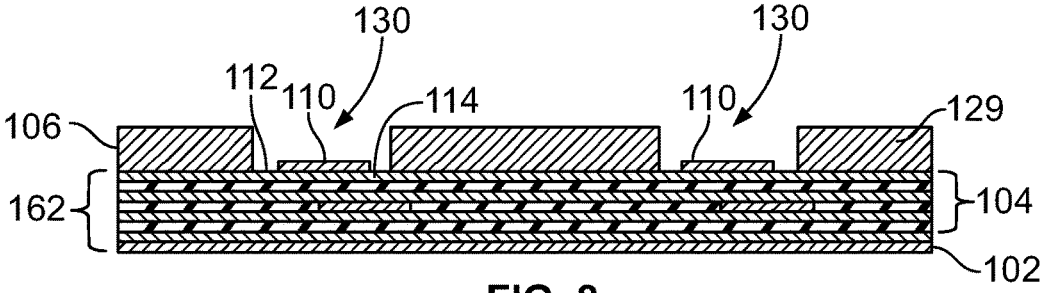
FIG. 8 illustrates a cross-sectional view of a cavity layer disposed over an antenna sub-assembly through line 3-3 of FIG. 2.

FIG. 8 illustrates a cross-sectional view of the cavity layer 106 disposed over the antenna sub-assembly 162 through line 3-3 of FIG. 2. The cavity layer 106 is positioned on the antenna sub-assembly 162 such that the antenna elements 110 are positioned within respective cavities 130. As shown, the antenna elements 110 extend upwardly into the cavities 130 from the upper surface 112 of the dielectric layer 114. The dielectric layer 114 may be adhesively secured to the sub-assembly 162, such as through lamination.

Figure 9:
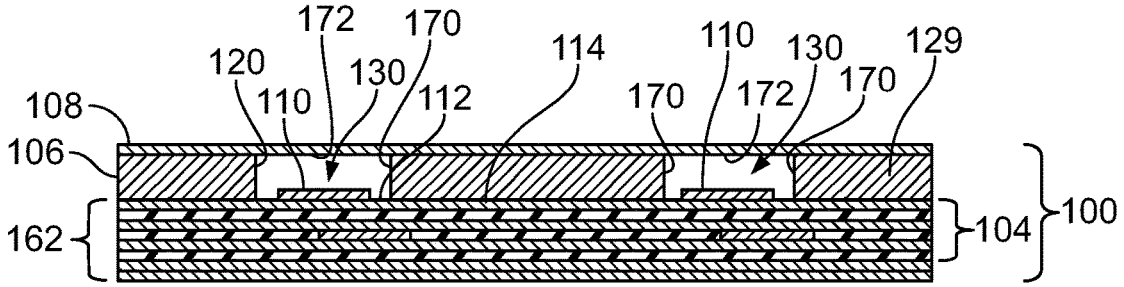
FIG. 9 illustrates a cross-section view of the antenna assembly through line 3-3 of FIG. 2.

FIG. 9 illustrates a cross-section view of the antenna assembly 100 through line 3-3 of FIG. 2. After the cavity layer 106 is secured to the antenna sub-assembly 162, the dielectric cover 108 (such as an additional dielectric layer) is secured over the cavity layer 106, such as via lamination. The dielectric cover 108 encloses the cavities 130. Each antenna element 110 is enclosed within a respective cavity 130. Each cavity 130 may be an internal cavity of the antenna assembly 100, and defined by the upper surface 112 of the dielectric support base 104, interior surfaces 170 of the main body 129 of the cavity layer 106, and a lower surface 172 of the dielectric cover 108.

Figure 10:
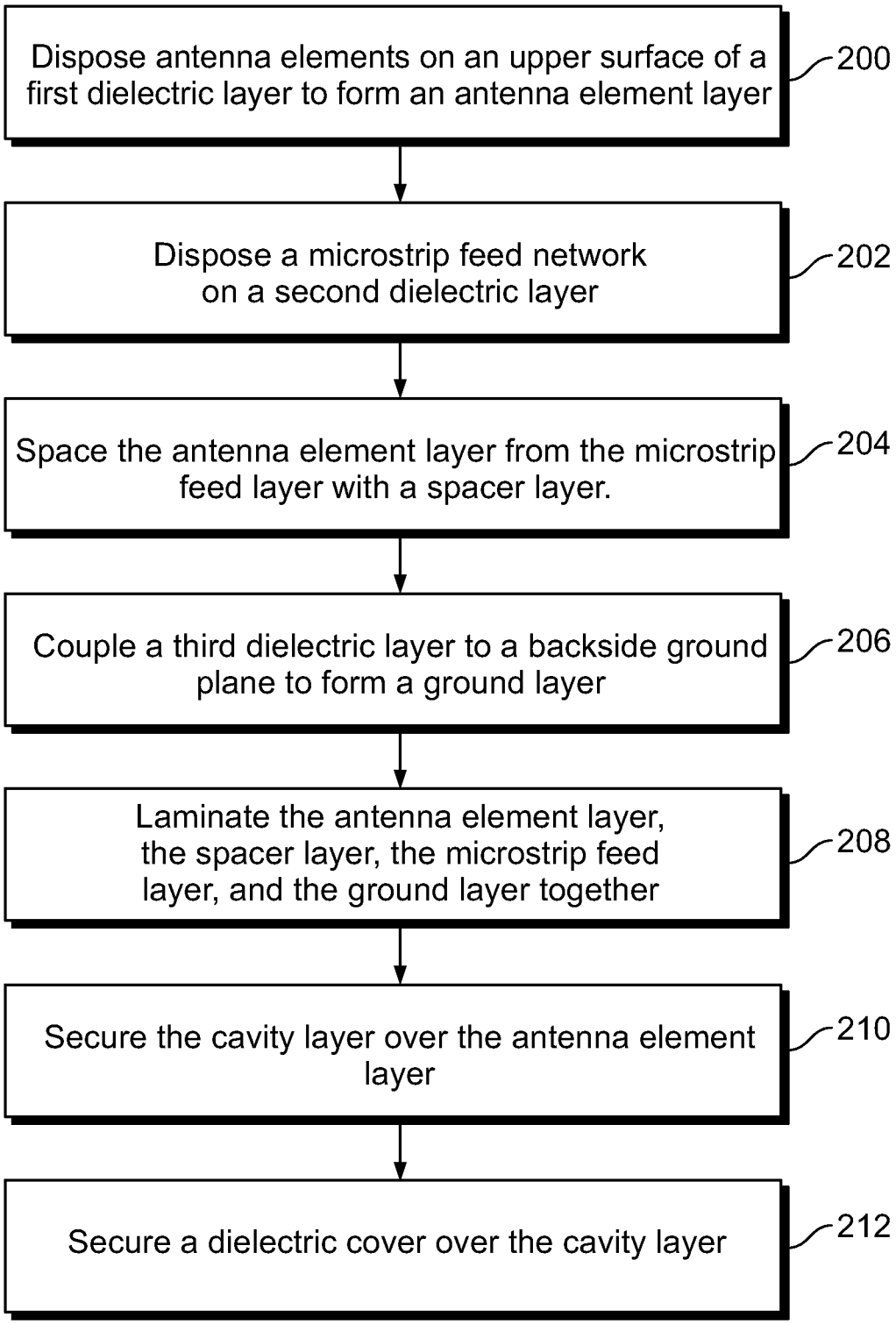
FIG. 10 illustrates a flow chart of a method of forming the antenna assembly, according to an embodiment of the present disclosure.

FIG. 10 illustrates a flow chart of a method of forming the antenna assembly, according to an embodiment of the present disclosure. Referring to FIGS. 1-10, at 200, the antenna elements 110 are disposed on the upper surface 112 of the dielectric layer 114 (for example, a first dielectric layer) to form the antenna element layer 140. Next, at 202, the microstrip feed network 120 is disposed on the dielectric layer 146 (for example, a second or third dielectric layer) to form the feed network layer 144. At 204, the spacing layer 142 (for example, a second or third dielectric layer) is disposed between the antenna element layer 140 and the feed network layer 144, thereby spacing the antenna element layer 140 from the feed network layer 144. Alternatively, the method may not include 204. At 206, the dielectric layer 150 (for example, a third or fourth dielectric layer) is coupled to the backside ground plane 102 to form the ground layer 148. At 208, the antenna element layer 140, the spacing layer 142, the feed network layer 144, and the ground layer 148 are laminated together. At 210, the cavity layer 106 is secured over the antenna element layer 140, such that the antenna elements 110 are within the cavities 130. At 212, the dielectric cover 108 is secured over the cavity layer, thereby enclosing the antenna elements 110 within the cavities 130.

As described herein, embodiments of the present disclosure provide compact and efficient antenna assemblies. Further, embodiments of the present disclosure provide antenna assemblies having microstrip feed networks that provide improved gain and bandwidth.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. An antenna assembly, comprising:

a dielectric support base including an antenna element layer having one or more antenna elements, wherein the one or more antenna elements comprise a main body having a slot and are disposed on a first dielectric surface of a dielectric layer, wherein the first dielectric surface is opposite from a second dielectric surface of the dielectric layer, and wherein the dielectric support base further comprises a microstrip feed network coupled to the one or more antenna elements;

a cavity layer coupled to the dielectric support base, wherein the cavity layer includes a main body formed of a conductive material, wherein one or more cavities are formed through the main body, wherein the one or more cavities extend between and through a first cavity surface of the cavity layer and a second cavity surface of the cavity layer, wherein the second cavity surface is opposite from the first cavity surface, wherein the one or more cavities are defined between the first dielectric surface and interior surfaces of the main body, and wherein the one or more antenna elements are disposed on the first dielectric surface within the one or more cavities; and a dielectric cover secured over the cavity layer.

2. The antenna assembly of claim 1, wherein the one or more antenna elements comprise at least two antenna elements.

3. The antenna assembly of claim 1, wherein the microstrip feed network is underneath the one or more antenna elements.

4. The antenna assembly of claim 1, wherein the dielectric support base further comprises a feed network layer having the microstrip feed network coupled to the one or more antenna elements, and wherein the feed network layer is further coupled to the antenna element layer.

5. The antenna assembly of claim 4, wherein the dielectric support base further comprises a spacing layer between the antenna element layer and the feed network layer.

6. The antenna assembly of claim 1, further comprising a backside ground plane coupled to the dielectric support base.

7. The antenna assembly of claim 6, wherein the backside ground plane is coupled to the dielectric layer of the dielectric support base.

8. The antenna assembly of claim 1, wherein the one or more antenna elements are enclosed within the one or more cavities between the first dielectric surface of the dielectric layer of the dielectric support base, interior surfaces of the main body of the cavity layer, and a surface of the dielectric cover.

9. A method of forming an antenna assembly, the method comprising:

providing a dielectric support base, wherein said providing the dielectric support base comprises forming an antenna element layer having one or more antenna elements, wherein the one or more antenna elements comprise a main body having a slot, wherein said forming the antenna element layer comprises disposing the one or more antenna elements on a dielectric layer, wherein said disposing the one or more antenna elements comprises disposing the one or more antenna elements on a first dielectric surface of the dielectric layer, wherein the first dielectric surface is opposite from a second dielectric surface of the dielectric layer, and wherein said providing the dielectric support base further comprises coupling a feed network layer having a microstrip feed network to the antenna element layer;

forming one or more cavities through a main body to form a cavity layer including a main body formed of a conductive material, wherein the one or more cavities extend between and through a first cavity surface of the cavity layer and a second cavity surface of the cavity layer, wherein the second cavity surface is opposite from the first cavity surface, and wherein the one or more cavities are defined between the first dielectric surface and interior surfaces of the main body;

coupling the cavity layer to the dielectric support base, wherein said coupling comprises disposing the one or more antenna elements on the first dielectric surface within the one or more cavities;

securing a dielectric cover over the cavity layer.

10. The method of claim 9, wherein said providing the dielectric support base further comprises spacing the antenna element layer from the feed network layer with a spacing layer.

11. The method of claim 9, further comprising coupling a backside ground plane to the dielectric support base.

12. The method of claim 9, wherein said securing comprises enclosing the one or more antenna elements within the one or more cavities between the first dielectric surface of the dielectric layer of the dielectric support base, interior surfaces of the main body of the cavity layer, and a lower surface of the dielectric cover.

13. An antenna assembly, comprising:

a dielectric support base including:

an antenna element layer having antenna elements, wherein at least one of the antenna elements comprises a main body having a slot, wherein the antenna elements are disposed on a first dielectric layer, wherein the antenna elements are disposed on a first dielectric surface of the first dielectric layer, wherein the first dielectric surface is opposite from a second dielectric surface of the first dielectric layer;

a feed network layer having a microstrip feed network coupled to the antenna elements, wherein the feed network layer is further coupled to the antenna element layer; and a spacing layer between the antenna element layer and the feed network layer;

a backside ground plane coupled to the dielectric support base, wherein the backside ground plane is coupled to a second dielectric layer of the dielectric support base;

a cavity layer coupled to the dielectric support base, wherein the cavity layer includes a main body formed of a conductive material, wherein cavities are formed through the main body, wherein the cavities extends between and through a first cavity surface of the cavity layer and a second cavity surface of the cavity layer, wherein the second cavity surface is opposite from the first cavity surface, wherein the cavities are defined between the first dielectric surface and interior surfaces of the main body, and wherein the antenna elements are disposed on the first dielectric surface within the cavities; and a dielectric cover secured over the cavity layer, wherein the antenna elements are enclosed within the cavities between an upper surface of the first dielectric layer, interior surfaces of the main body of the cavity layer, and a lower surface of the dielectric cover.

14. The antenna assembly of claim 1, wherein the one or more antenna elements comprise four antenna elements, and wherein the one or more cavities comprise four cavities.

15. The antenna assembly of claim 1, wherein the microstrip feed network is embedded within the dielectric layer.

16. The method of claim 9, wherein the one or more antenna elements comprise four antenna elements, and wherein the one or more cavities comprise four cavities.

17. The method of claim 9, wherein the microstrip feed network is embedded within the dielectric layer.

18. The antenna assembly of claim 13, wherein the antenna elements comprise four antenna elements, and wherein the cavities comprise four cavities.

* * * * *